US007958997B2

(12) United States Patent
Smithers

(10) Patent No.: US 7,958,997 B2
(45) Date of Patent: Jun. 14, 2011

(54) REVERSIBLE MODULAR CAN INTERLOCKING DEVICE

(76) Inventor: Matthew Charles Smithers, Lewisville, TX (US)

( * ) Notice: Subject to any disclaimer, the term of this patent is extended or adjusted under 35 U.S.C. 154(b) by 0 days.

(21) Appl. No.: 11/977,094

(22) Filed: Oct. 23, 2007

(65) Prior Publication Data

US 2008/0093243 A1 Apr. 24, 2008

Related U.S. Application Data

(60) Provisional application No. 60/853,638, filed on Oct. 23, 2006.

(51) Int. Cl.
*B65D 65/00* (2006.01)
*B65D 75/00* (2006.01)

(52) U.S. Cl. ..... 206/427; 206/150; 206/145

(58) Field of Classification Search ..... 206/821, 206/518, 430, 427, 150, 145, 148, 149, 151, 206/159, 147; 294/87.2; 220/23.4, 23.6
See application file for complete search history.

(56) References Cited

U.S. PATENT DOCUMENTS

| | | | | |
|---|---|---|---|---|
| 3,250,564 | A * | 5/1966 | Stern et al. | 294/87.2 |
| 3,317,087 | A * | 5/1967 | Landis | 222/143 |
| 3,640,018 | A * | 2/1972 | Light | 446/77 |
| 4,120,396 | A * | 10/1978 | Mascia et al. | 206/151 |
| 5,964,343 | A * | 10/1999 | Steiner | 206/203 |
| 7,404,486 | B2 * | 7/2008 | Smithers | 206/427 |

* cited by examiner

*Primary Examiner* — Gregory Pickett
*Assistant Examiner* — Kaushikkumar Desai

(57) ABSTRACT

A reversible modular beverage can interlocking device which is adapted for forming a plurality of conventional beverage cans into a building block for use as a toy or in display applications or in building construction. The device generally comprises a plurality of thermoplastic reversible annular means for can retention, each sized and shaped for the releasable retention of either the top lipped portion of a beverage can, or the bottom non-lipped portion of a beverage can.

3 Claims, 5 Drawing Sheets

REVERSIBLE MODULAR CAN INTERLOCKING DEVICE

CROSS REFERENCE TO RELATED APPLICATIONS

This application claims the benefit of U.S. Provisional Application No. 60/853638 Titled: Modular Can Interlocking Device, filed Oct. 23, 2006

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

FIELD OF THE INVENTION

This invention relates generally to the field of promotional products, toys and construction and more specifically to a system of interconnecting a plurality of beverage cans in a modular fashion. The present invention allows beverage cans to be easily assembled into combined modular units for display thereof or for building various structures such as playhouses, forts, or the like.

BACKGROUND OF THE INVENTION

It has been observed that there exists an overabundance of waste materials produced by our society and that means to re-utilize these materials, has for a large part, been overlooked. In recent years, the concept of recycling has gained momentum wherein basic consumer goods such as paper, plastic, glass, aluminum, or the like may be re-instituted into the consumer product chain, thus alleviating the load on the environment. Moreover, as we have become more of a disposable product based society, it has become more important to re-use all the materials we can and in all possible ways. Adding to this is pressure be more responsible with our common resources, especially materials particularly lending themselves to recycling such as aluminum, paper, glass, and plastic. It has further been observed that our society produces a rather large amount of beverage cans such as those for the containment of soft drinks, beer, or other edible juices. Research has shown that as many as 156 billion cans were produced in the year of 2003 yet only 42% of these cans were recycled.

In order to provide a use for empty beverage cans, various designs have been suggested which allows a plurality of beverage cans to be releasably mounted one upon another in a modular fashion. U.S. Pat. No. 3,815,281 to Kander, U.S. Pat. No. 4,170,082 to Freedman, U.S. Pat. No. 4,474,491 to Ferrarelli, and U.S. Pat. No. 4,764,143 to Gat, et al. disclose various beverage can stacking devices having varying types of releasable retention means for the top and bottom ends of a conventional beverage can. However, all of these devices are capable of interconnecting only one can co-axially to another can; the interconnecting of additional cans which are disposed laterally relative thereto must be accomplished via complicated and cumbersome interconnect mechanisms whose retentive strength would most likely degrade due to extended use. Moreover, the interconnect mechanisms as described in the aforementioned patents do not allow a plurality of cans which are laterally interconnected relative to one another to be optimally "packed" together in order to form a building block with minimal spacing therebetween.

Another drawback is that the releasable retention means for the top and bottom portion of a conventional can as described in in the aforementioned patents is dimensioned to optimally fit only one size of can. Notwithstanding, it is well known that there are several varying styles of beverage cans, each having slightly varying dimensions, which are currently distributed in these United States. Thus, any of the aforementioned devices which has been optimally sized for use with one style of can would possibly be rendered useless with a beverage can of a different style.

Yet another drawback of the aforementioned designs is that neither device discloses a top portion can engagement member having an annular depression formed therein for resilient retainment of the lip of a top portion of a beverage can therein in conjunction with a bottom portion can engagement member for resilient friction engagement of the bottom portion of a beverage container disposed coaxially thereabove. This aspect of the prior art, by itself, reveals a salient utilitarian ramification. The can stacking device having annular depressions formed in both of the coaxially disposed can engagement members would only optimally retain the top portion of a conventional can, thus inverting the longitudinal orientation of the proceeding can therebeneath thereby hindering the ability to stack successive cans above or below in an optimal manner.

U.S. Pat. No. 4,120,396 to Mascia et al. that is directed to the retention of cans with both top and bottom lips does allow for the interconnecting of multiple cans co-axially, but will not allow the cans to be removed simply by bending slightly. Additionally, the Mascia design is functional only insofar as the material is a rigid thermoplastic and indeed would be rendered non-functioning if constructed of a more flexible thermoplastic as is the preferred material of the present invention. It is to be understood that the configuration of the current embodiment is not to be limited to a fixed number of cans, and may be in any configuration not limited to the current rectangular configuration.

BRIEF SUMMARY OF THE INVENTION

In accordance with the present invention, there is disclosed a modular beverage can interlocking device comprising a plurality of thermoplastic reversible annular retention means having a first position and a second position for holding plural cans; each reversible annular retention means has an annular inner wall defining an orifice through the annular device, the annular wall having an upper portion of lesser diameter and a lower portion of greater diameter and where the upper portion of the annular wall has an indentation that is shaped and sized to releasibly retain the top lip of a beverage can.

In the first position, the indentation of the upper annular wall releasibly retains the top lip of a beverage can, while the lower portion is held in intimate contact with that part of the can below the lip and thus supports the side wall of the beverage can.

In the second position, a narrowing portion of the lower annular wall releasibly retains the top lip of a beverage can, while the upper portion is logically divided into two parts; an indentation, and a beveled support surface adjacent to the indentation, rests below the lipped portion of a can with the beveled support surface being in intimate contact with that part of the can below the lip thus supporting the side wall of the beverage can.

A plurality of fillets interconnect said plurality of reversible annular retention means in a generally co-planar orientation thereby allowing a plurality of said beverage cans to be interconnected side-by-side with respect to each other, such that a modular style building block is formed which is adapted for stacking, one upon another.

Preferably, the reversible annular retention means are disposed in at least one column of multiple evenly spaced linear rows whereby the interlocking device having the lower portion of the reversible annular retention means thereof populated with cans forms a generally rectangular shaped block which is easily interconnected with other populated interlocking devices. Additionally, means are described to allow the usage of varying styles or sizes of beverage cans via an inwardly facing annular slot, which is adapted to engage the lip of said can therein.

A primary object of the present invention is to provide a means of promoting cans to be recycled into productive useful items.

Another object of the present invention is to provide a means of connecting cans into a repeatable functional unit of building.

Another object of the present invention is to provide a creative promotional item for shipping and selling of liquids in cans.

A further object of the present invention is to provide a means of displaying can collections in a organized manner.

Still another object of the present invention is to provide a modular style beverage can interlocking device which obviates the disadvantages of the cited references while providing a device which is inexpensive to manufacture, and thus inexpensive for the end user.

Other objects and advantages of the present invention will become apparent from the following descriptions, taken in connection with the accompanying drawings, wherein by way of illustration and example, preferred embodiments of the present invention are disclosed.

BRIEF DESCRIPTION OF THE DRAWINGS

The drawings constitute a part of this specification and include exemplary embodiments of the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Figure 1:
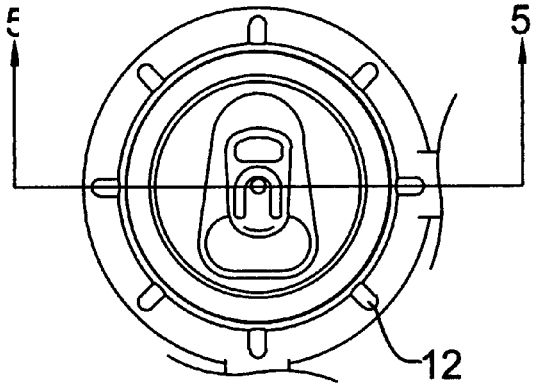
FIG. 1 is a top plan cutaway view of one embodiment according to the present invention showing the reversible annular retention means of the device with registration tabs in a first position atop a can.

As shown in FIGS. 1 through 9, a reversible modular beverage can interlocking device embodying a preferred embodiment of a device according to the current invention and designated generally by the reference numeral 10'. The device is described as being of a thermoplastic material such as injection molded polyethylene, polypropylene, polyurethane, however this is not to be construed as limiting the material or process.

FIG. 1 is a top plan cutaway view showing the positioning of the unitary thermoplastic device atop a beverage can in a first position. Shown also are integrated registration tabs.

Figure 2:
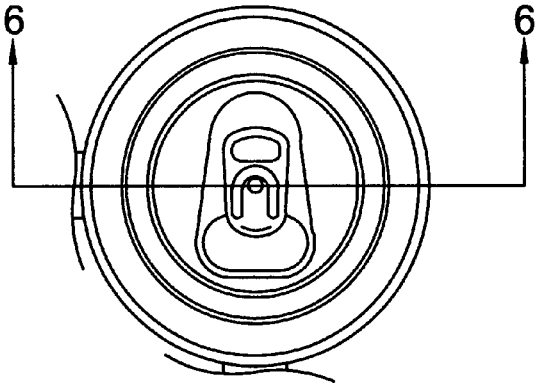
FIG. 2 is a top plan cutaway view of one embodiment according to the present invention showing the reversible annular retention means of the device in a second position atop a can.

FIG. 2 is a top plan cutaway view showing the positioning of the unitary thermoplastic device atop a beverage can in a second position.

Figure 3:
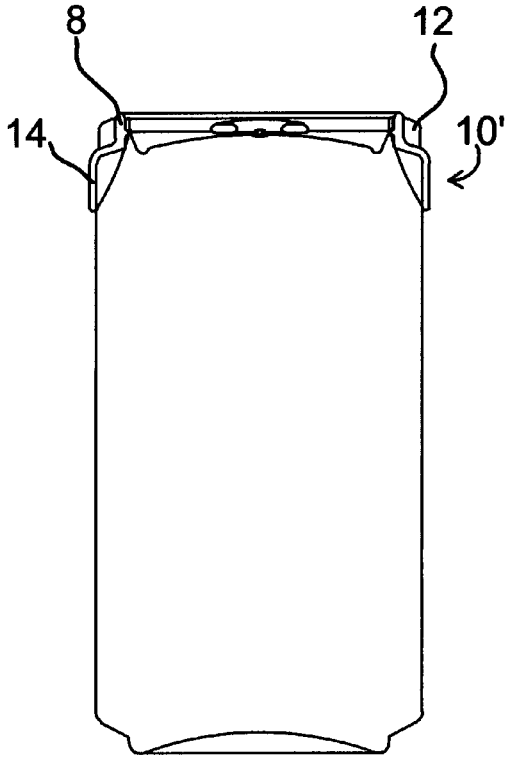
FIG. 3 is cross sectional view, taken along line 5-5 of the FIG. 1.

FIG. 3 is a is cross sectional view, taken along line 5-5 of (FIG. 1), showing the thermoplastic reversible annular retention means for holding plural cans 10', in a first position, with an inner annular wall having a upper portion 8 encircling a lip of a beverage can, and a lower portion 14 and a narrowing portion 14*b* thereof seated below the lip of the beverage can; shown also are the registration tabs 12.

Figure 4:
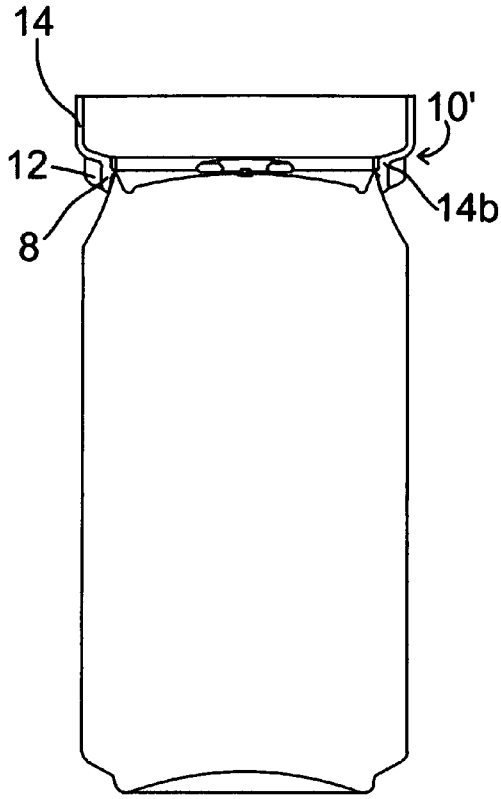
FIG. 4 is cross sectional view, taken along line 6-6 of the FIG. 2.

FIG. 4 is a is cross sectional view, taken along line 6-6 of (FIG. 2) reversing the position of 10', showing the thermoplastic reversible annular retention means for holding plural cans 10' in a second position, with an inner annular wall having a upper portion 8 now seated below a lip of a beverage can, and portion 14*b* now encircling the lip of the beverage can; shown also are the registration tabs 12.

Figure 5:
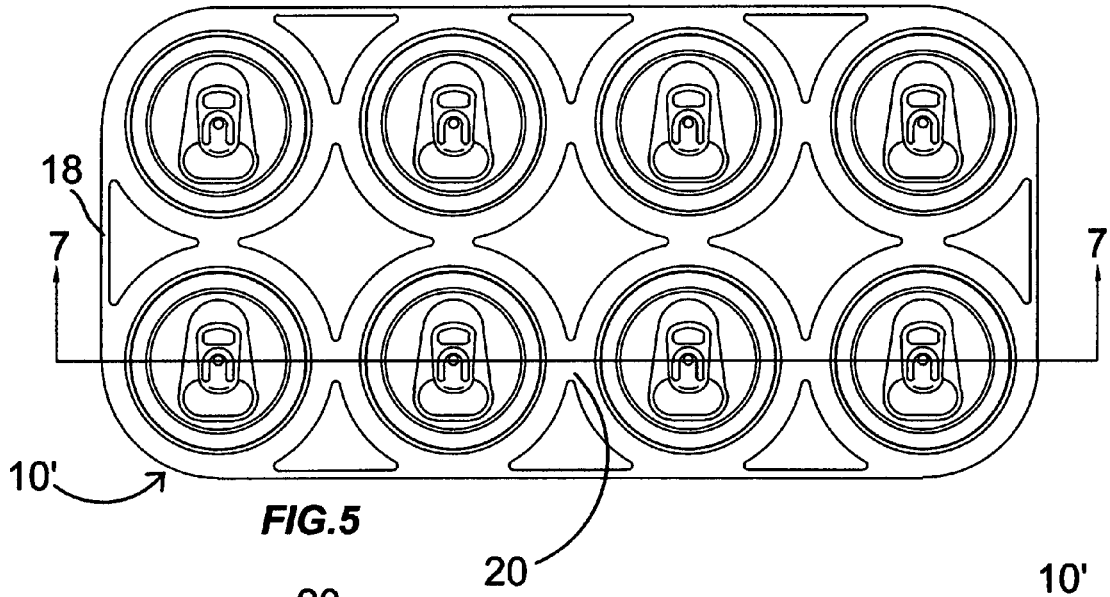
FIG. 5 is a top plan view of one embodiment of the present invention showing fillets connecting the reversible annular retention means of the device shown without registration tabs.

FIG. 5 is a top plan view of one embodiment of the present invention showing outer fillets 18, an inner fillets 20, connecting the reversible annular retention means of the device without registration tabs.

Figure 6:
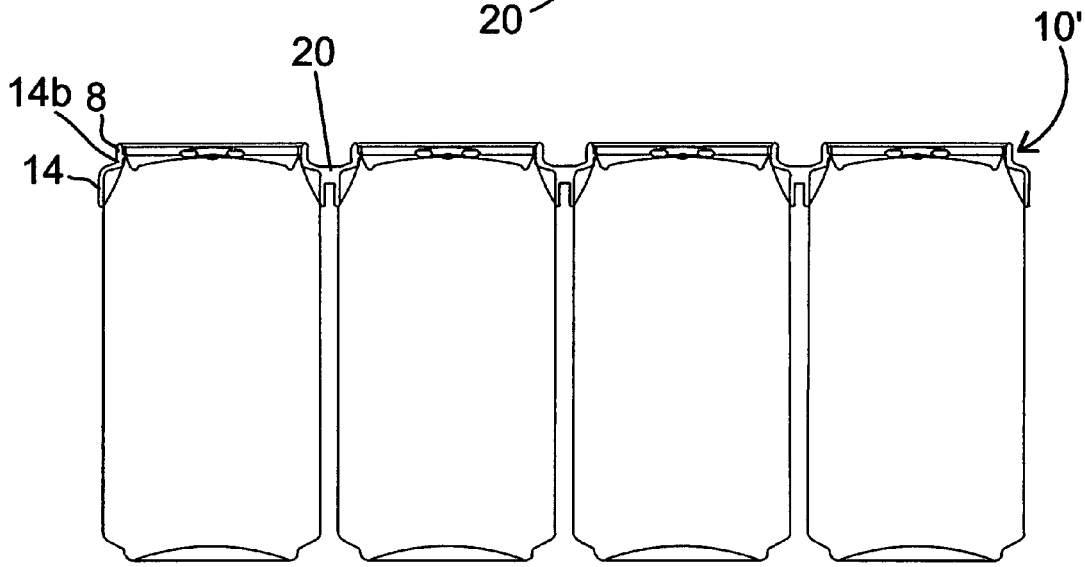
FIG. 6 is cross sectional view, taken along line 7-7 of the FIG. 5.

FIG. 6 is cross sectional view, taken along line 7-7 of the FIG. 5 of the current invention 10', in a first position, showing the relationship of the inner annular wall portions 8,14 and 14*b* to a plurality of retained beverage cans.

Figure 7:
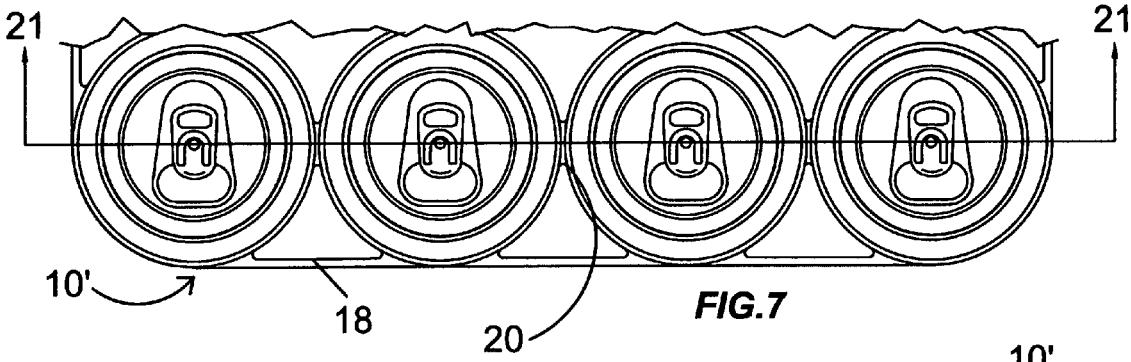
FIG. 7 is a partial plan view of one embodiment of the present invention showing fillets connecting the reversible annular retention means of the device shown here without registration tabs.
Figure 8:
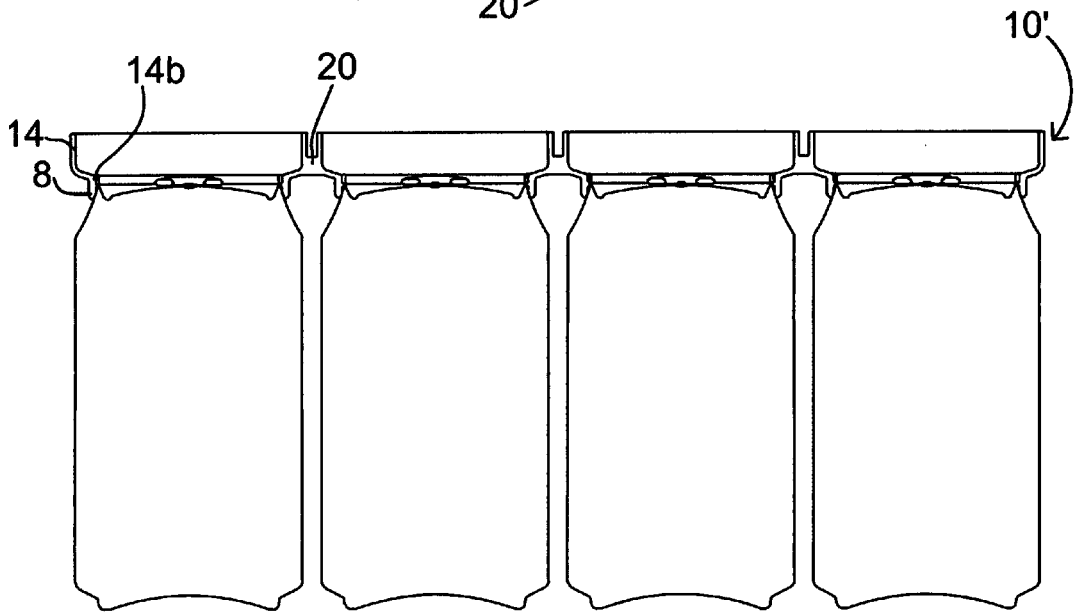
FIG. 8 is cross sectional view, taken along line 21-21 of the FIG. 7.

FIG. 7 is a partial plan view of one embodiment of the present invention showing fillets 18, 20 connecting the reversible annular retention means of the current invention 10', FIG. 8 is cross sectional view, taken along line 21-21 of the FIG. 7 showing the current invention in the second position showing the upper portion 8, of the inner annular wall in intimate contact with the area below the beverage can lip. This position supports the wall of the can for added stability, reducing lateral movement, maintains alignment of the inferior cans in coaxial agreement to superiorly placed cans, and prevents the inner annular wall of the current invention from slipping down the side wall of the inferiorly situated can.

Figure 9:
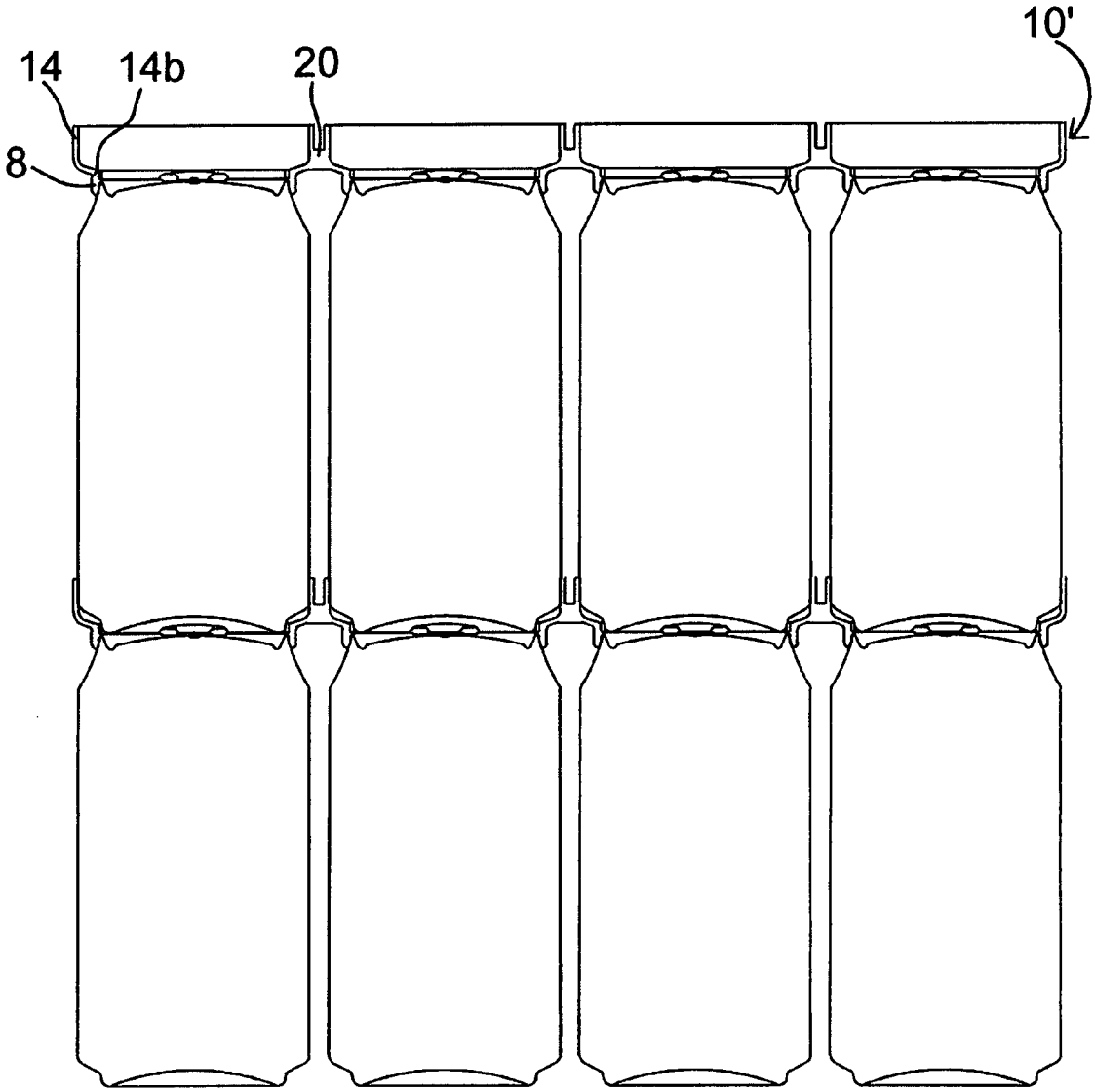
FIG. 9 is elevational view showing an embodiment with cans stacked position, taken along line 21-21 of the FIG. 7.

FIG. 9 is side view showing an embodiment in the second position with cans modularly stacked, taken along line 21-21 of the FIG. 7; showing the mating surfaces of the top and bottom of the beverage cans when held in alignment by the plurality of the reversible annular retention means of the current invention.

Figure 10:
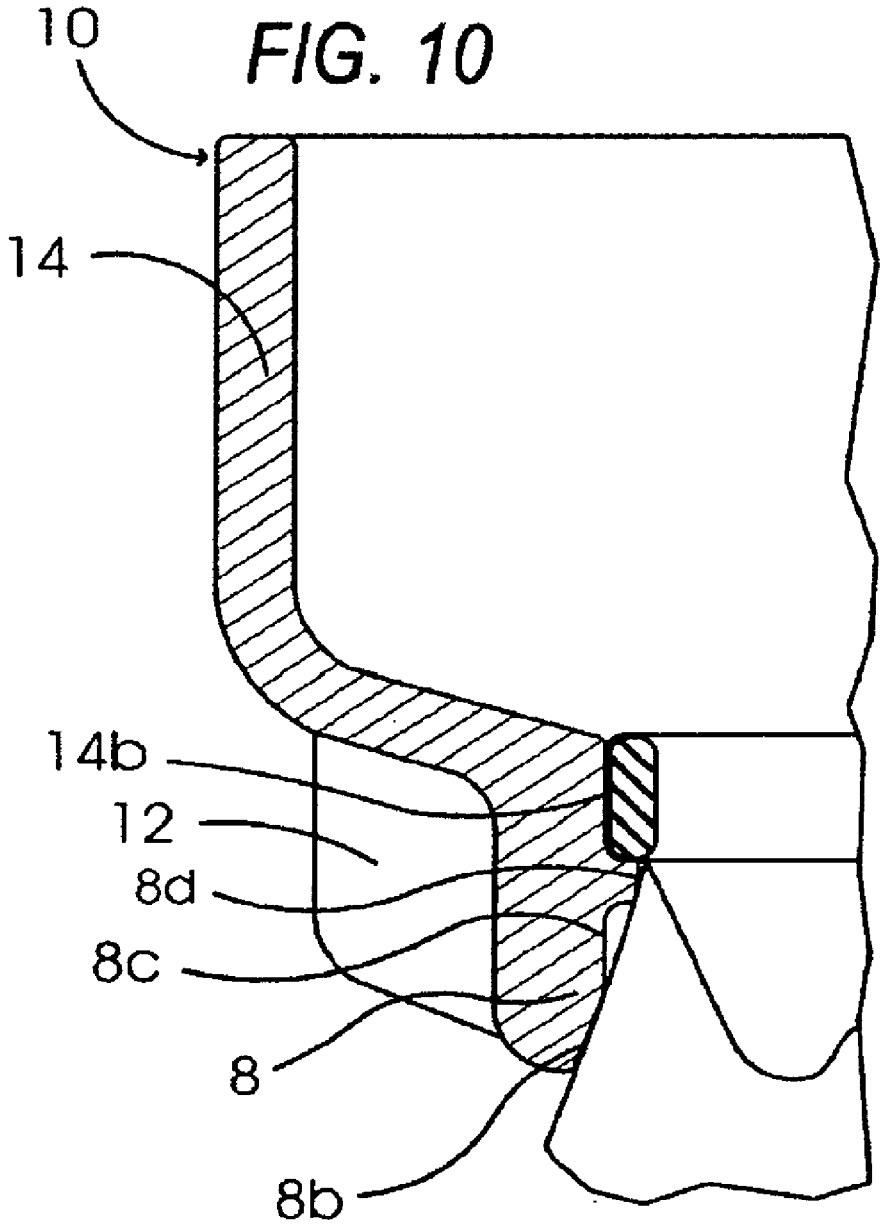
FIG. 10 is detail cutaway view of, (FIG. 4).

FIG. 10 is detail cutaway view of, (FIG. 4) showing the portions of the upper and lower inner annular wall in greater detail, specifically the distinction between the upper portion 8, of the inner annular wall and the beveled support surface 8*b* adjacent to 8.

I claim:

1. A modular can interlocking device comprising plural thermoplastic reversible annular means for holding plural cans having a first position and a second position, (1) each reversible annular means for holding plural cans having an annular inner wall defining an orifice through the annular device, the inner annular wall having a lower portion and an upper portion, (a) the reversible annular means for holding plural cans in said first position, said upper portion of the inner annular wall having a single indentation (8*c*) with a radially swept face generally parallel to a side of the can lip formed annularly, said indentation in the upper portion (8) of the inner annular wall and being sized to releasably secure an upper annular ring of a first can when the can lip is inserted into the indentation(8*c*), and the lower portion (14) of the inner annular wall of the annular device being sized and shaped to releasably secure and support the upper portion of said first can by means of intimate contact, and, (b) the reversible annular means for holding plural cans in second position, said lower portion (14) of the inner annular wall being sized and shaped to releasably secure the bottom non-lipped portion of a can by means of a snug friction-fit, and a narrowing portion (14*b*) of said inner annular wall of said annular device being sized to releasably secure an upper annular ring of a first can lip when inserted into said indentation (8*c*), and said upper portion (8) of the inner annular wall being sized to encircle and support (8*d*) that area below the lip of said can with additional support from a beveled support surface (8*b*) adjacent to said indentation and tapering unimpeded from said radially swept face to an opening of the annular means, and, (2) the plural annular means for holding plural cans being arranged in a planar relationship with adjacent annular means for holding plural cans being connected by a fillet(20).

2. A modular can interlocking device comprising plural thermoplastic reversible annular means for holding plural cans having a first position and a second position, (1) each reversible annular means for holding plural cans having an annular inner wall defining an orifice through the annular device, the inner annular wall having an upper portion (8) of lesser diameter and a lower portion (14) of greater diameter, (a) the reversible annular means for holding plural cans in said first position, said upper portion (8) of the inner annular wall having a single indentation (8*c*) with a radially swept face generally parallel to a side of the can lip formed annularly, said indentation in the upper portion (8) of the inner annular wall being sized to releasably secure an upper annular ring of a first can when the can lip is inserted into the indentation(8*c*), and the lower portion (14) of the inner annular wall of the annular device being sized and shaped to releasably secure and support the upper portion of said first can by means of intimate contact, and, (b) the reversible annular means for holding plural cans in second position, said lower portion (14) of the inner annular wall being sized and shaped to releasably secure the bottom non-lipped portion of a can by means of a snug friction-fit, and a narrowing portion (14*b*) of said inner annular wall of said annular device being sized to releasably secure an upper annular ring of a first can lip is inserted into said indentation (8*c*), and said upper portion (8) of the inner annular wall having an encircling support (8*d*) supportive of that area below the lip of said can with additional support from a beveled support surface (8*b*) adjacent to said indentation and tapering unimpeded away from said radially swept face, the encircling support (8*d*) supportive of the underside of a can lip when the can is in either said first position or second position and, (2) the plural annular means for holding plural cans being arranged in a planar relationship with adjacent annular means for holding plural cans being connected by a fillet(20).

3. A modular can interlocking device comprising plural thermoplastic reversible annular means for holding plural cans having a first position and a second position in which the cans have at least one non-lipped base, a lip and a shoulder, (1) each reversible annular means for holding plural cans having an annular inner wall defining an orifice through the annular device, the inner annular wall having an upper portion (8) of lesser diameter and a lower portion (14) of greater diameter, (a) the upper portion of lesser diameter having an annular indentation (8*c*) having a radially swept face generally parallel to a side of the can lip formed in the inner annular wall shaped and sized to releasably secure an upper annular ring of a first can when the can ring is inserted into the indentation (8*c*) when said can is inserted ring first through said lower portion (14) of greater diameter, and the lower portion (14) of greater diameter being sized and shaped to secure and support the upper portion of said first can by means of intimate contact, in which the position of the can relative to the annular means defines a first position, and, (b) the lower portion of greater diameter (14) having a narrowing portion (14*b*) of said inner annular wall being sized to releasably secure an upper annular ring of a can when said can is inserted ring first through said upper portion (8) of lesser diameter, in which the position of the can relative to the annular means defines a second position, and said lower portion of greater diameter (14) of the inner annular wall being sized and shaped to releasably secure the bottom non-lipped portion of a can by means of a snug friction-fit, and said upper portion (8) of the inner annular wall being having an encircling support (8*d*) below the lip of said can with additional support from a beveled support surface (8*b*) adjacent to said indentation and tapering away from the radially swept face and, (2) said indentation (8*c*) and said narrowing portion (14*b*) of said inner annular wall being separated by said encircling support (8*d*) residing just under said upper annular ring of a can lip when the position of the can relative to the annular device is in said first and second positions, the encircling support (8*d*) sized and shaped to encircle and support that area below the lip of said can with additional support from a beveled support surface (8*b*) adjacent to said indentation, and the plural annular means for holding plural cans being arranged in a planar relationship with adjacent annular means for holding plural cans being connected by fillets (20).

* * * * *